United States Patent [19]

Schwang

[11] Patent Number: 4,533,117

[45] Date of Patent: Aug. 6, 1985

[54] LIFTING DEVICE

[76] Inventor: Per-Eric Schwang, Dannemansvägen 36, S-181 41 Lidingö, Sweden

[21] Appl. No.: 464,811

[22] Filed: Feb. 8, 1983

[30] Foreign Application Priority Data

Feb. 11, 1982 [SE] Sweden ..... 8200725

[51] Int. Cl.[3] ..... B66F 7/22

[52] U.S. Cl. ..... 254/94; 254/131

[58] Field of Search ..... 254/129, 131, 94; 248/649, 148, 454, 555; 280/47.12, 47.2

[56] References Cited

U.S. PATENT DOCUMENTS

| | | | |
|---|---|---|---|
| 110,309 | 12/1870 | Tetro | 294/17 |
| 685,458 | 10/1901 | McIntyre | 248/455 |
| 1,996,612 | 4/1935 | Cook | 254/94 |
| 2,676,710 | 4/1954 | Williamson | 280/47.19 |
| 2,733,895 | 2/1956 | Trenkle | 294/17 |
| 2,837,305 | 6/1958 | Andrew | 248/148 |
| 3,652,056 | 3/1972 | King | 254/94 |
| 3,740,015 | 6/1973 | Adams | 248/454 |
| 4,221,416 | 9/1980 | Piontkowski et al. | 254/94 |

FOREIGN PATENT DOCUMENTS

| | | | |
|---|---|---|---|
| 989391 | 4/1965 | United Kingdom | 254/131 |

*Primary Examiner*—Robert C. Watson

*Attorney, Agent, or Firm*—Griffin, Branigan & Butler

[57] ABSTRACT

The invention concerns a device for lifting objects, such as logs, from the ground. A substantially L-shaped lever assembly is comprised of a shorter leg (2); a longer leg (3); and, an adjustable connecting means (9) for adjustably connecting the shorter leg (2) to the longer leg (3). The end of the shorter leg (2) constitutes a first ground contacting support (11), about which the lever is swingable upon manual actuation of the handle end (8) of the longer leg (3). Upon such swinging a pivotable hook means (5,6) engages an object (7), which is lifted from the ground. An adjustable lower portion of the longer leg (3) is extensible along the axis of the longer leg (3) and serves as a second ground contacting support (14) to keep the lever and the lifted object in the raised position. The second ground support is arrestable relative to the axis of the longer leg.

2 Claims, 5 Drawing Figures

LIFTING DEVICE

Figures 1, 2, 3, 4, 5:
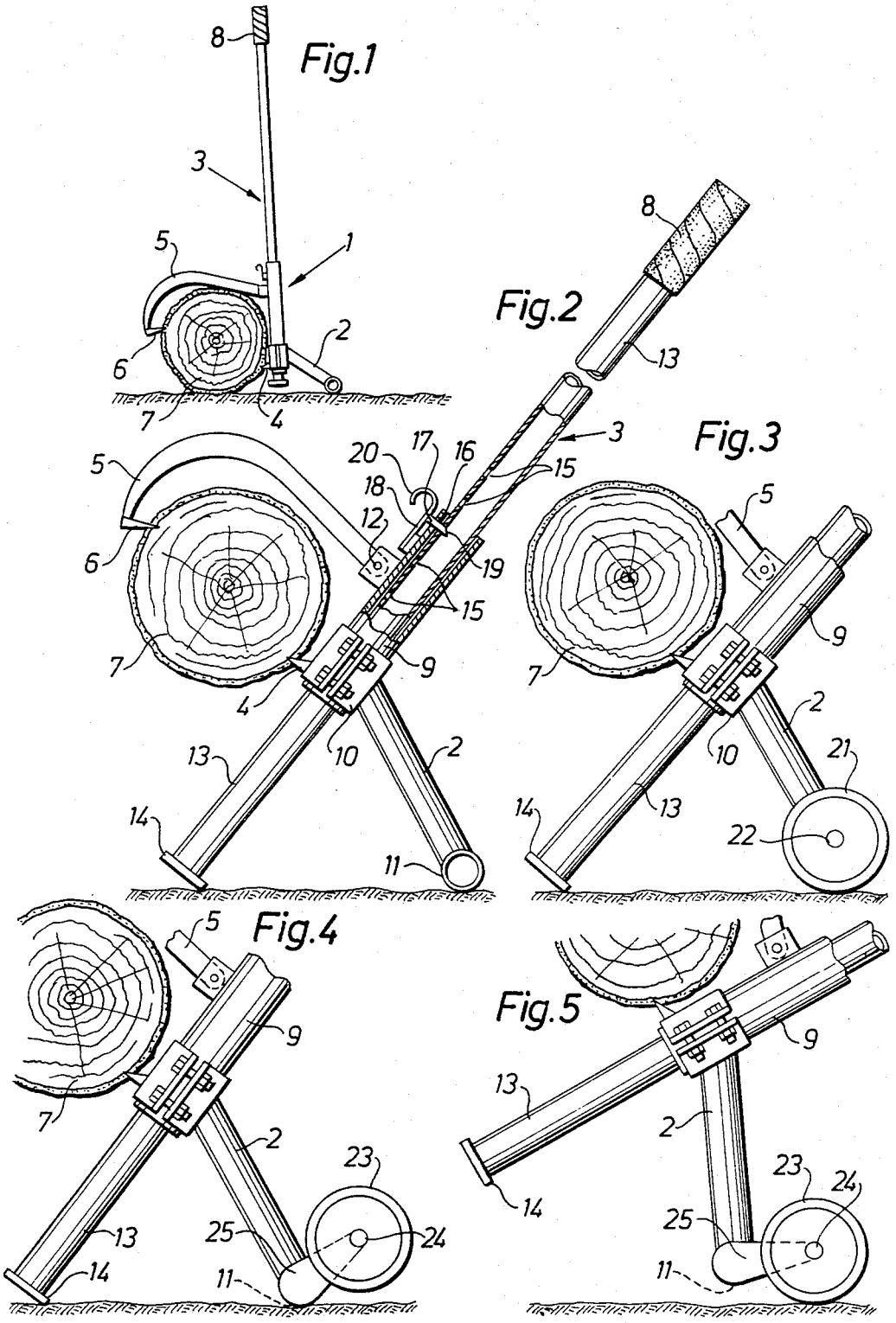

The present invention concerns a device for lifting preferably cylindrical objects, such as logs, pipes etc. from the ground, comprising a substantially L-shaped lever, the end of the shorter leg of which as a ground support constitutes a fulcrum for its longer, manually actuated leg, engagement means being mounted for swinging in the transition area between the legs, said engagement means being adapted to engage an object to be lifted upon actuation of said longer leg.

Devices of this kind are known among others from Swiss Expose D'Invention Brevet Principal A-402 735 and U.S. Pat. No. 4,221,416. They are meant for lifting a log, and particularly for raising a log end from the ground to facilitate sawing with a chain saw. The known devices are adapted to be swung with their longer legs from a substantially vertical position, in which engagement with a log takes place, to a substantially horizontal position, in which the end of the longer leg rests on the ground. In the beginning of the swinging motion a swingable hook means engages the log and brings it along. During the swinging motion the centre of gravity of the log passes above the fulcrum of the device.

A device of this kind has the drawback that the longer leg must be brought all the way down to ground level and fetched therefrom when the work is finished, which means strains on the back. Further, there is a risk that the swingable hook means, engaging the log during lifting looses its engagement when the log, in its raised position, rests entirely on the approximately horizontal longer leg. During the work the log may then roll so that its centre of gravity is located above or at least dangerously close to the fulcrum of the lever, which may lead to a situation where the lever uncontrolledly and with great power swings up at the same time as the log, of course, again falls to the ground. The object of the invention is to achieve a development of the known device, which sets aside the drawbacks mentioned.

This has been achieved in that the invention has been given the characteristics stated in the claims appended below.

Apart from the fact that the longer leg of the lever according to the invention now never needs to be swung to a horizontal position before the extensible support is made operative, it is at the same time achieved that the raised object never comes to rest on the longer leg but all the time loads the swingable engagement means, which, thus, fixes the object in the position where the engagement initially took place.

The invention will now be described with reference to the accompanying drawing, wherein FIG. 1 shows a side-view of a device according to the invention in the substantially vertical position of engagement, FIG. 2, at an enlarged scale and in part section, shows the device according to the invention with the extensible support in an operative position, FIG. 3 is a view similar to that according to FIG. 2 but showing a wheeled device according to the invention, and FIGS. 4 and 5 show in a corresponding manner another embodiment of a wheeled device according to the invention in two different positions of operation.

Like the known devices of the present kind, the device according to the invention includes a lever 1 angled into approximately L-shape and having a shorter leg 2 and a longer leg 3. In the transition area between the legs there is a fixed spike 4 and at a distance up along the longer leg 3 is journalled a swingable, curved arm 5 having an engagement hook 6 in its outer end.

As now described, the device corresponds in all essentials to the known devices and can be also be used as such, i.e. from the position shown in FIG. 1, where the longer leg 3 is substantially vertical and the swingable hook 6 is engaged into a log 7, the entire lever can be swung to the right according to FIG. 1 about the end of the shorter leg 2 until the handle end 8 of the longer leg 3 lies on the ground and the log 7 is lift up.

In order to set aside the drawbacks of the known devices mentioned above, the device according to the invention, however, is provided with a second ground contacting support being an extensible portion of the longer leg along the axis of the longer leg and which can be brought into contact with the ground in any suitable swinging position of the longer leg, and, in that position, be arrested relative to the axis of the longer leg.

In the embodiment shown in detail in FIG. 2, the actual longer leg is a tube 13 which is jacketed by outer tube 9 which serves as means to adjustably connect the longer 3 with the shorter leg 2. At the lower end of tube 9 a press connection 10 is used to attach the shorter leg 2 to the tube 9. The lower end of the shorter leg 2 is provided a first ground contacting support 11 in the shape of a transverse tube. On the upper side of the press connection 10 is attached the fixed hook 4. On the tube 9 the arm 5 is journalled for swinging about an axle 12.

Inside the adjustable connecting tube means 9 is displacedly guided the longer tube 13 which in its upper end carries a handle 8 and at its lower end is provided with a transverse support plate 14 serving as the second ground contacting support 14. In the tube 13 is provided a plurality of holes 15. In a hole 16 in the tube 9 a pin 17 is guided, which pin is pushed by a spring 18 towards the tube 13. The pin 17 can be brought into engagement with any one of the holes 15 thereby locking the tubes 9 and 13 to each other and arresting motion of the longer tube 13 along its axis. preferably the foremost end 19 of the pin 17 is bevelled such that the pin 17 is pushed out of the holes 15 when the tube 13 is downwardly displaced towards the ground, but remains in the holes 15 upon force against the tube 13 in the opposite direction. In order to manually release the pin 17 from the holes 15 the spring 18 has a handle 20.

It is appreciated that, with the device according to the invention, one can halt the swinging of the tube 13 when it still has a comfortable direction and height and the log or other object is sufficiently raised from the ground. Then the tube 13 is pushed down along its axis relative to tube 9 until its support plate 14 contacts the ground and is locked relative to the tube 9 by engagement of the pin 17 in one of the holes 15. Which of the holes 15 that is chosen depends on the thickness of the log, ground conditions etc.. Suitably there is a hole 15 in the position where the tube 13 is retracted so that the support plate 14 abuts the lower end of the tube 9.

Within the scope of the invention a pluraltiy of other embodiment can be contemplated as regards the attachment of the extensible support to the lever as well as its guidance and arresting. For instance, the support could be guided in external guides on the longer leg. In the form of execution shown, with cylindrical tubes slidable in each other, the mutual locking could be made with a fixed bolt on one of the tubes which bolt engages in a longitudinal slot in the other tube having laterally directed locking slots.

The art of attachment of the shorter leg 2 and the hook 4 to the tube 9 by means of the pressing connection 10 allows displacement along the tube 9, by loosening, moving, and retightening the press fitting 10. This may advantageous especially for varying the distance between the hook 4 and the pivot point 12 of the swingable hook 5,6.

In order to facilitate the moving of a raised log and also to facilitate the transportation of the lifter itself, it could with preference be provided with wheels, placing one wheel at each end of the first ground contacting support 11.

FIG. 3 shows such a wheel 21 being mounted on a shaft 22 which in turn is coaxially located relative to the tubular first ground contacting support 11 in FIG. 2. From the position shown in FIG. 3 the second ground contacting support plate 14 may now be raised from the ground by swinging the handle 8 to the right according to FIG. 2, whereby the entire device rotates about the shaft 22 such that the log is carried merely by the wheels 21.

FIGS. 4 and 5 show a variation, wherein wheels 23 are mounted on shafts 24 which in turn are mounted on arms 25 projecting from the shorter leg 2 or the first ground contacting support 11. As appears, the angle between the arms 25 and the leg 2, the length of the arm 25 and the dimensions of the wheels 23, are so adapted to each other that the function of the device shown in FIG. 2 is still maintained, i.e. there is a support against the ground at the second ground contacting support plate 14 as well as at the first ground contacting support of leg 2. FIG. 5 shows the situation when the device has been swung around the shaft 24 such that not only the support plate 14 is lifted from the ground but also the lower part of the leg 2, or possibly the ground support 11, is raised such that the entire device with the carried log now can be rolled. From FIG. 4 also follows that the initial function of the device according to FIG. 1 is still performable, since the position shown in FIG. 1 involves a greater distance of the wheel 23 from the ground compared to the position according to FIG. 4.

Within the scope of the invention many modification can be made.

For instance, in one preferred embodiment the adjustable connecting tube 9 and the longer leg tube 13 have rectangular cross-sections with their longer sides vertically directed. The means for arresting the longer leg tube 13 relative to the adjustable connecting tube 9 may include a screw means engaged in a screw threaded hole in the tube 9, such that the screw upon tightening presses against the tube 13 to frictionally arrest same. Preferably the threaded hole is located on the underside of the tube 9.

Apart from frictional arresting the positive arresting, such as described with reference to FIG. 2, the conditions may very well be such that relative displacement between the tubes 13 and 9 does not occur due to self-braking when the device is under load with the extensible support in an operative position.

Also, to compensate for certain unevenness of the ground, it is suitable to have the joint between the shorter leg 2 and the ground support 11 articulated within certain limits.

It has also proved functionally advantageous to make the fixed spike 4 comprise two laterally spaced spikes, thereby diminishing the risk of rotation of a log around a single spike.

The embodiments of the invention shown and described above have been directed to log lifting. The device according to the invention, however, is suitable also for handling other objects such as large pipes, poles or the like made of wood, concrete, steel or other common materials.

It may then be necessary to modify the swingable engagement means as well as the fixed one to suit the respective material. For instance, to handle a relatively smooth steel pipe, the swingable engagement means could be made of relatively hard, high friction rubber having a relatively great engagement area, whereas, for handling a concrete object, a wooden shoe could be provided at the free end of the swingable arm.

What is claimed is:

1. A device for lifting objects from the ground, comprising:

a substantially L-shaped lever having a shorter leg and a longer leg, the end of the shorter leg forming a ground support and constituting a fulcrum for the longer leg;

engagement means being swingably connected to the longer leg so as to engage an object to be lifted upon actuation of the longer leg;

support means extensible in the direction of the longer leg for holding the object in the raised position;

said longer leg and said adjustable connecting means each including at least one bore through respective surfaces thereof;

pin means selectively insertable into said bores for interlocking said longer leg and said adjustable connecting means; and, said adjustable connecting means including both swinging and stationary engagement means to engage an object to be lifted.

2. A log lifting device, comprising:

(i) a straight, tubular sleeve member, said sleeve member comprised of (a) a first tooth means rigidly attached thereto;

(b) an arm swingably attached at one of its ends to said sleeve member, said arm having a second tooth means at its free end;

(c) a leg depending from said sleeve member, said leg having a ground support portion forming a fulcrum for the lifting device; and, (d) arresting means; and, (ii) a straight, continuous bar member being slidably inserted in said tubular sleeve member and being arrestable in selective positions relative thereto by said arresting means, said bar member including a ground support portion at one of its ends and a handle portion at the other of its ends.

* * * * *